US008479627B2

(12) United States Patent
Keller et al.

(10) Patent No.: US 8,479,627 B2
(45) **Date of Patent: *Jul. 9, 2013**

(54) SAFETY DEVICES FOR SAWS

(75) Inventors: David V. Keller, Jackson, TN (US); Mark D. Hickok, Waukesha, WI (US); Peter L. Domeny, Northbrook, IL (US); Thornton H. Gogoll, III, Baltimore, MD (US); David G. Peot, Easley, SC (US); Stan M. Rodrigues, Pleasnaton, CA (US); Christopher S. Tennant, Clemson, SC (US)

(73) Assignee: Power Tool Institute, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/306,892

(22) Filed: Nov. 29, 2011

(65) Prior Publication Data

US 2012/0067186 A1 Mar. 22, 2012

Related U.S. Application Data

(63) Continuation of application No. 12/054,881, filed on Mar. 25, 2008, now Pat. No. 8,091,456.

(51) Int. Cl.
*B26D 7/22* (2006.01)

(52) U.S. Cl.
USPC ..... 83/477.2; 83/522.11; 83/DIG. 1

(58) Field of Classification Search
USPC ..... 83/477.2, 520, 522.11, 58, 522.12, 83/DIG. 1
See application file for complete search history.

(56) References Cited

U.S. PATENT DOCUMENTS

| | | | | |
|---|---|---|---|---|
| 3,731,520 | A * | 5/1973 | Hickman et al. | 73/73 |
| 6,900,728 | B2 * | 5/2005 | Metzger, Jr. | 340/562 |
| 7,249,992 | B2 * | 7/2007 | Kalenian et al. | 451/11 |
| 2004/0040169 | A1 * | 3/2004 | Davis | 33/640 |
| 2005/0248303 | A1 * | 11/2005 | Garcia et al. | 318/480 |
| 2006/0101960 | A1 * | 5/2006 | Smith et al. | 83/58 |
| 2006/0101961 | A1 * | 5/2006 | Etter et al. | 83/76.8 |
| 2006/0155582 | A1 * | 7/2006 | Brown | 705/3 |
| 2008/0016998 | A1 * | 1/2008 | Keller | 83/13 |
| 2010/0037739 | A1 * | 2/2010 | Anderson et al. | 83/58 |

* cited by examiner

*Primary Examiner* — Stephen Choi
(74) *Attorney, Agent, or Firm* — K&L Gates LLP

(57) ABSTRACT

In various embodiments, a saw can include a work surface and a blade at least partially extending through the work surface. In at least one embodiment, the saw can further include a sensor and a light emitter, wherein the light emitter can be configured to emit a first light beam and a second light beam onto at least a portion of the work surface. In various embodiments, the sensor can be can be configured to detect a plurality of saw conditions and, owing to communication between the sensor and the light emitter, the light emitter can be configured to emit the first light beam onto the work surface when the sensor detects a first saw condition and emit the second light beam onto the work surface when the sensor detects a second saw condition.

20 Claims, 11 Drawing Sheets

SAFETY DEVICES FOR SAWS

CROSS-REFERENCE TO RELATED APPLICATIONS

The present application is a continuation of copending U.S. patent application Ser. No. 12/054,881, filed Mar. 25, 2008.

BACKGROUND i. Field of the Invention

The present invention generally relates to saws and, more particularly, to safety devices for saws.

ii. Description of the Related Art

Saws can often include safety devices, or saw accessories, that can protect an operator from being injured while using the saws. Table saws, for example, can include saw accessories such as a blade guard, a riving knife, and/or one or more anti-kickback pawls. A blade guard can be disposed over and/or around a saw blade to reduce the likelihood that the operator may accidentally touch the saw blade. A riving knife may be mounted to the saw in alignment with the blade such that the riving knife can be positioned within and/or engage a slot, or kerf, in a workpiece created by the blade. In such circumstances, the riving knife can prevent, or at least inhibit, portions of the workpiece from pinching onto the blade and, as a result, prevent the workpiece from lifting upwardly or kicking back toward the operator. In various embodiments, one or more anti-kickback pawls can be attached to the blade guard and/or riving knife, for example, in such a manner as to prevent, or at least inhibit, the workpiece from lifting upwardly by forcing the workpiece against a work surface of the saw.

In various embodiments, an operator may be required to change and/or adjust the saw accessories described above, thereby often exposing the operator's hands, for example, to an area proximate to the blade. In other circumstances, an operator may often position their hands proximate to the blade as they feed the workpiece through the rotating blade, for example. Previously, however, such saws have not been provided with an indicator which can easily communicate to the operator that the saw is in a powered and/or operating mode, for example, and, as a result, operators have often not been able to readily discern the operating condition of the saw. What is needed is an improvement over the foregoing.

SUMMARY

In at least one form of the invention, a saw can include a work surface, a blade at least partially extending through the work surface, at least one sensor, and a light emitter which can be configured to emit a first light beam when the sensor detects a first saw condition and a second light beam when the sensor detects a second saw condition. In at least one embodiment, the first light beam can comprise a first color and the second light beam can comprise a second color. In various embodiments, the sensor can be configured to detect various saw conditions, such as blade speed, for example. In at least one embodiment, the sensor configured to detect whether the blade is stationary and/or moving and output a signal indicating the same. In various embodiments, the light emitter can receive the signal from the sensor and can be configured to emit the first light beam when the sensor detects the blade is stationary and/or, similarly, emit the second light beam when the sensor detects that the blade is moving.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate various embodiments of the invention, in one form, and such exemplifications are not to be construed as limiting the scope of the invention in any manner.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 1:
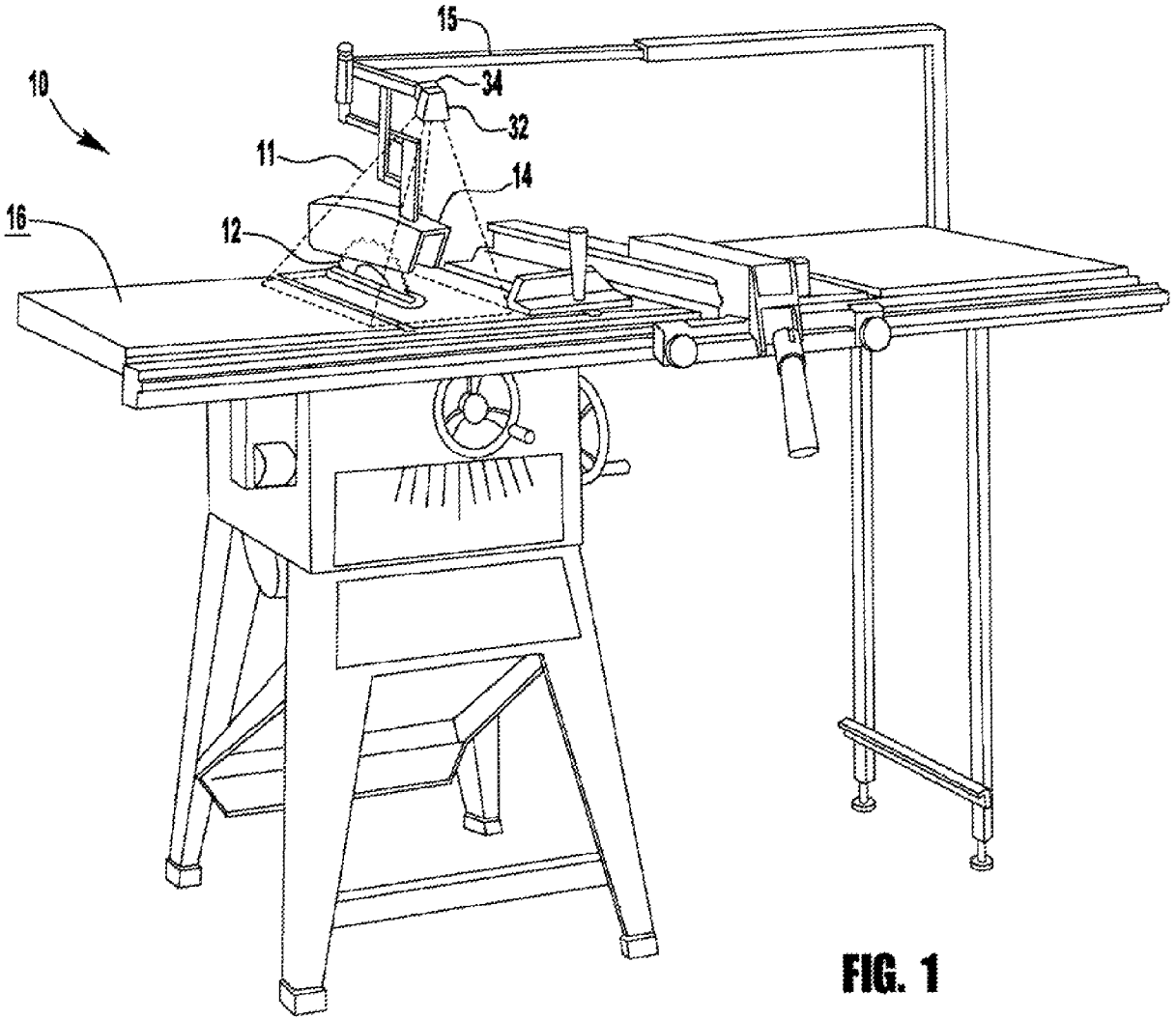
FIG. 1 is a perspective view of a saw having a plurality of saw accessories and a light emitter attached thereto in accordance with one non-limiting embodiment of the present invention.
Figure 2:
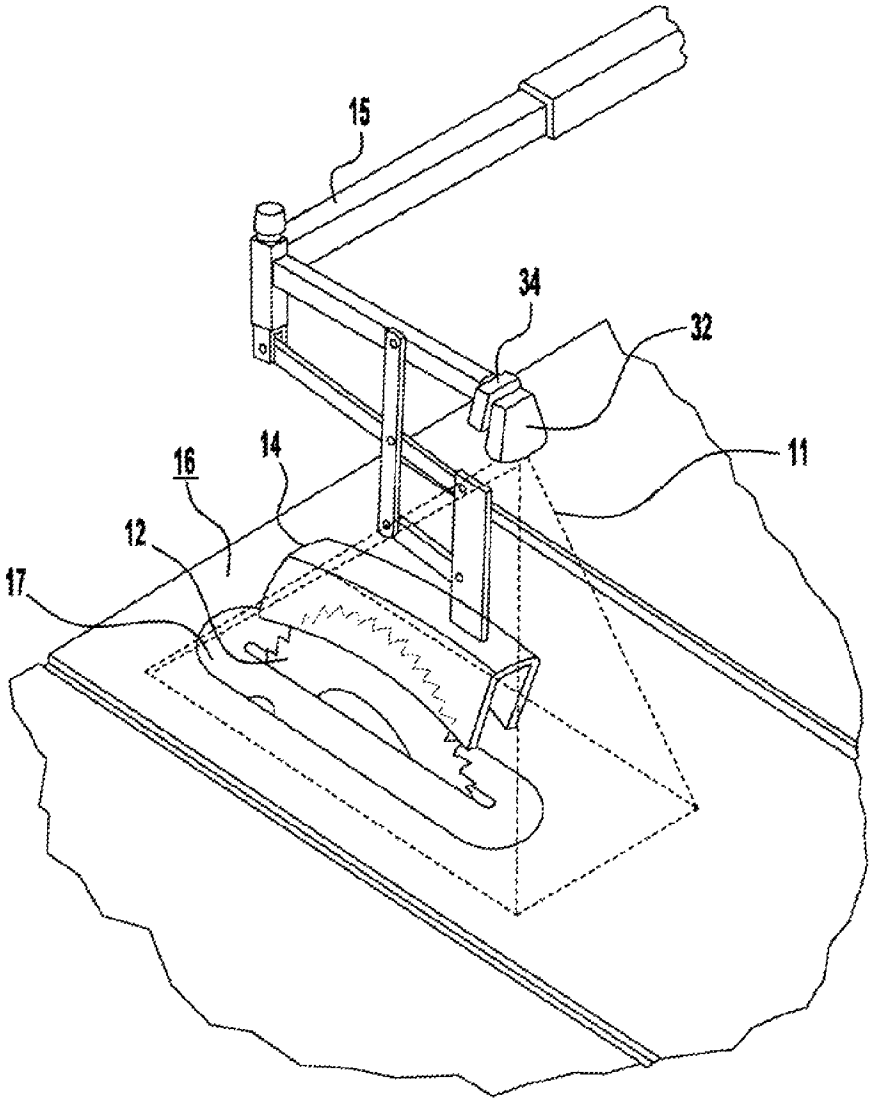
FIG. 2 is a partial perspective view of the saw accessories and the light emitter of FIG. 1.
Figure 3:
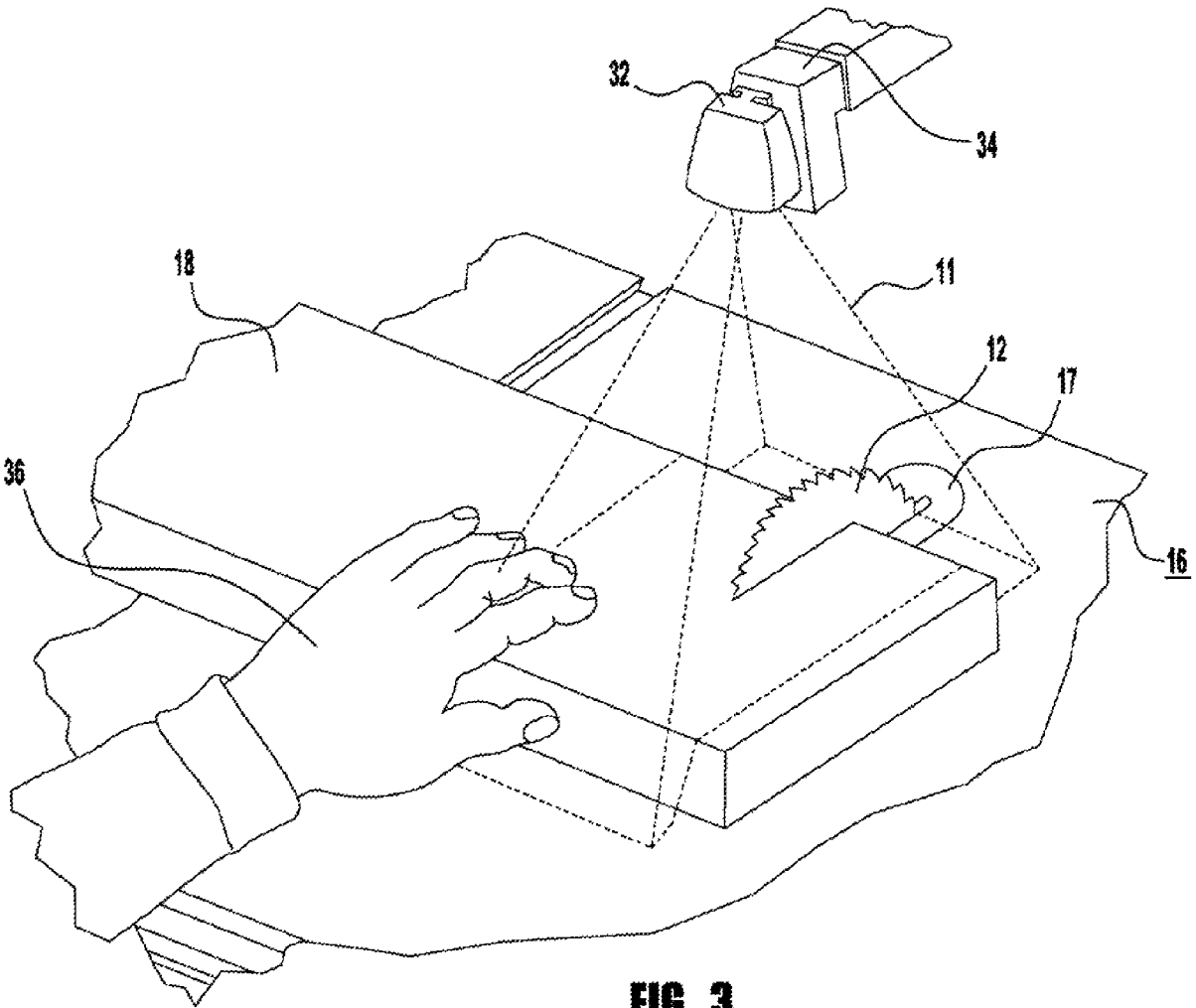
FIG. 3 is a partial perspective view of the saw accessories and the light emitter of FIG. 2 illustrating an operator's hand positioned on a workpiece.
Figure 4:
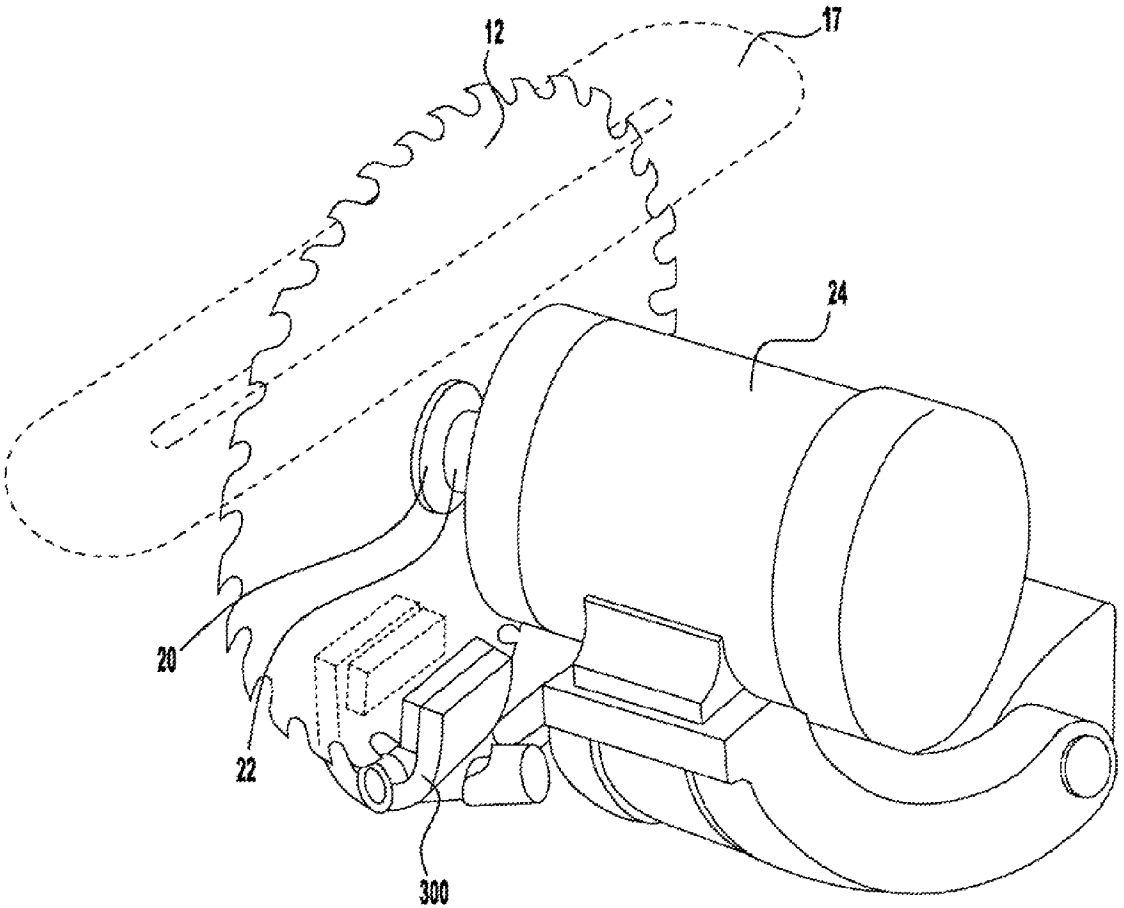
FIG. 4 is perspective view of a motor, a drive shaft, an arbor, and a saw blade of the saw of FIG. 1.

In various embodiments, a saw can have a plurality of saw accessories attached thereto where, as described above, the saw accessories can be configured to protect an operator during the operation of the saw, for example. In at least one embodiment, referring to FIGS. 1-4, saw 10 can include rotatable blade 12, blade guard 14, and work surface 16. In various embodiments, blade guard 14 can be positioned over and/or around blade 12 such that blade guard 14 can prevent, or at least inhibit, the operator from contacting blade 12. In various embodiments, work surface 16 can surround blade 12 and can be configured to support workpiece 18 (FIG. 3) thereon. In at least one embodiment, blade 12 can extend through throat plate 17, wherein the top surface of throat plate 17 can be situated substantially flush with work surface 16, for example. In various embodiments, referring to FIG. 4, blade 12 can be operably connected to arbor 20 wherein arbor 20 can be operably connected to a first end of drive shaft 22. In at least one such embodiment, a second end of drive shaft 22 can be operably connected to actuator, or motor, 24 wherein motor 24 can be configured to rotate drive shaft 22 and, correspondingly, rotate arbor 20 and blade 12. In other various embodiments, although not illustrated, the arbor and/or blade can be motivated in any other suitable fashion such as through the use of a belt drive system, for example.

Figure 5:
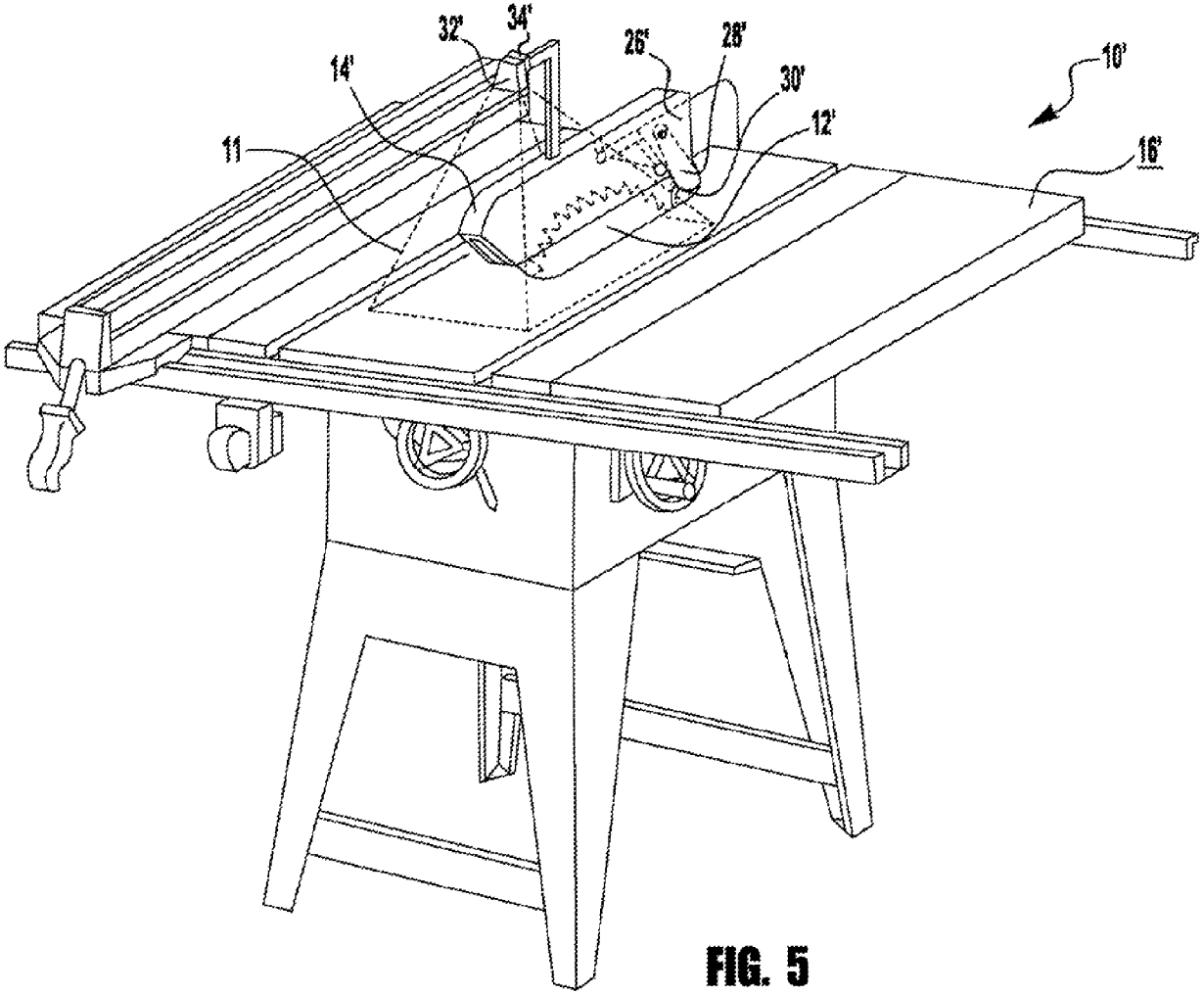
FIG. 5 is a perspective view of a saw having a plurality of saw accessories and a light emitter attached thereto in accordance with one non-limiting embodiment of the present invention.

In other various embodiments, referring to FIG. 5, saw 10' can include blade 12', blade guard 14', working surface 16', riving knife 26', and at least one anti-kickback pawl 28'. In at least one embodiment, riving knife 26' can be situated in alignment with the blade 12' such that riving knife 26' can be configured to engage a kerf in workpiece 18 which is created by blade 12' as it passes through the workpiece. In various circumstances, riving knife 26' can prevent portions of workpiece 18 from pinching onto a portion of blade 12' and being lifted upwardly and/or kicked back toward the operator. In various embodiments, at least one anti-kickback pawl 28' can be attached to riving knife 26' and/or blade guard 14', wherein pawl 28' can be configured force the workpiece against work surface 16'. In at least one embodiment, a portion of an outer perimeter of pawl 28' can include teeth 30' which can be configured to engage and grip a top and/or side surface of workpiece 18 and aid in preventing the workpiece from lifting upwardly or kicking back toward the operator.

In addition to or in lieu of the saw accessories described above, in various embodiments, a saw can further include a light emitter configured to project at least one visible light beam configured to indicate the condition, or operating mode, of the saw to the operator. In at least one embodiment, referring to FIGS. 1-3 and 5, light emitter 32 can be attached to light emitter holder 34 positioned on blade guard holder 15. In various embodiments, referring to FIG. 1, light emitter 32 can include at least one light source configured to project or emit light beam 11, for example, onto at least a portion of work surface 16 which surrounds blade 12. In other various embodiments, referring to FIG. 5, light emitter 32 and/or light emitter holder 34 can be attached to blade guard 14', riving knife 26', and/or one of anti-kickback pawls 28', for example. In any event, the light emitter can include one or more light source, wherein each light source can comprise one or more light bulb, light emitting diode (LED), laser, and/or any other suitable light emitting source configured to project a light, or light beam, onto a portion of the saw such as work surface 16, for example. In various alternative embodiments, light emitter 32 can comprise a single light source which can be configured to project two or more different-colored light beams therefrom, for example.

In at least one embodiment, light beams 11 emitted by light emitter 32 can be configured to indicate when saw 10 is powered, when blade 12 is rotating, and/or when human body part 36 is proximate rotating blade 12, for example. In various embodiments, as outlined above, light emitter 32 can include first light source 44 and second light source 46, for example, where each light source can be configured to emit a different visible light beam in order to indicate a different saw condition. In at least one embodiment, the light beam projected from first light source 44 can comprise a green light beam, for example, which can indicate to the operator that blade 12 may be stationary and that it may be safe to work proximate to blade 12. Similarly, the light beam projected from second light source 46 can comprise a red light beam which can indicate to the operator that the operator should use caution when working around blade 12 as the blade may be rotating. In other various embodiments, any suitable colors, and/or shades or intensities of the same color, can be used to indicate whether the blade is stationary and/or moving, for example. In various embodiments, the first and second light sources can be configured to emit light beams at the same, or substantially the same, location including, for example, an area surrounding blade 12. In other various embodiments, the light sources can be configured to emit beams directed to different locations on the saw. In further various embodiments, the light sources can be configured to emit light which is not necessarily directed toward a portion of the saw, but is otherwise visible to the operator.

In various embodiments, although not illustrated, a light emitter can be used without light emitter holder 34 wherein, in such embodiments, the light emitter can be attached to, or positioned relative to, the saw at any suitable location. In various embodiments, light emitter 32 and/or light emitter holder 34 can include a reflective shield configured to aid in directing the emitted light beams in a suitable direction, such as downwardly onto work surface 16 and/or workpiece 18, for example. Further to the above, in at least one embodiment, light emitter 32 and/or light emitter holder 34 can further include a power supply in the form of a battery or other suitable light powering source to energize one or more light sources within the light emitter. In other various embodiments, the light sources of light emitter 32 can be powered by actuator, or motor, 24.

Figure 6:
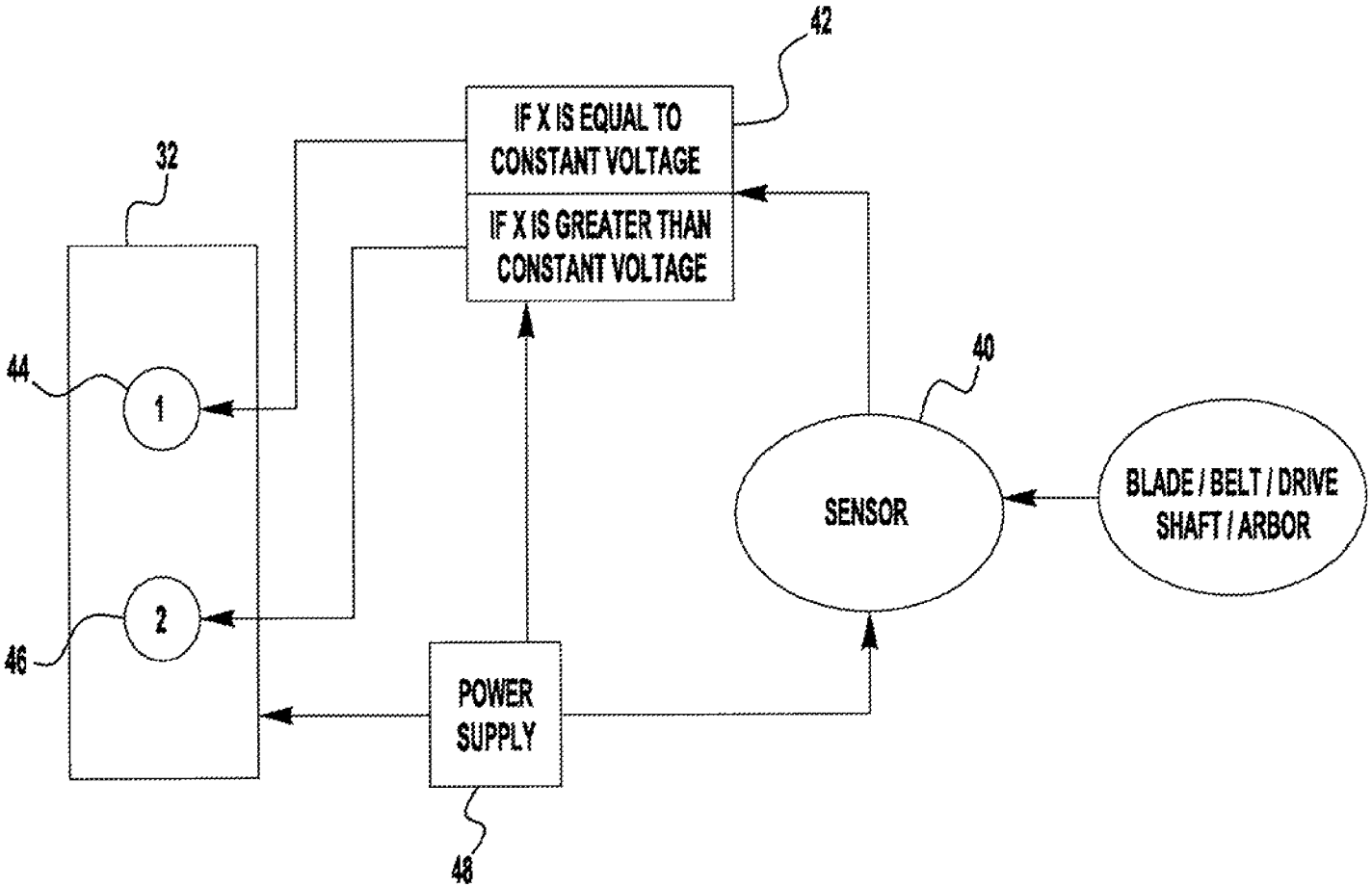
FIG. 6 is a diagram of a circuit used to selectively display first and second lights in accordance with one non-limiting embodiment of the present invention.
Figure 7:
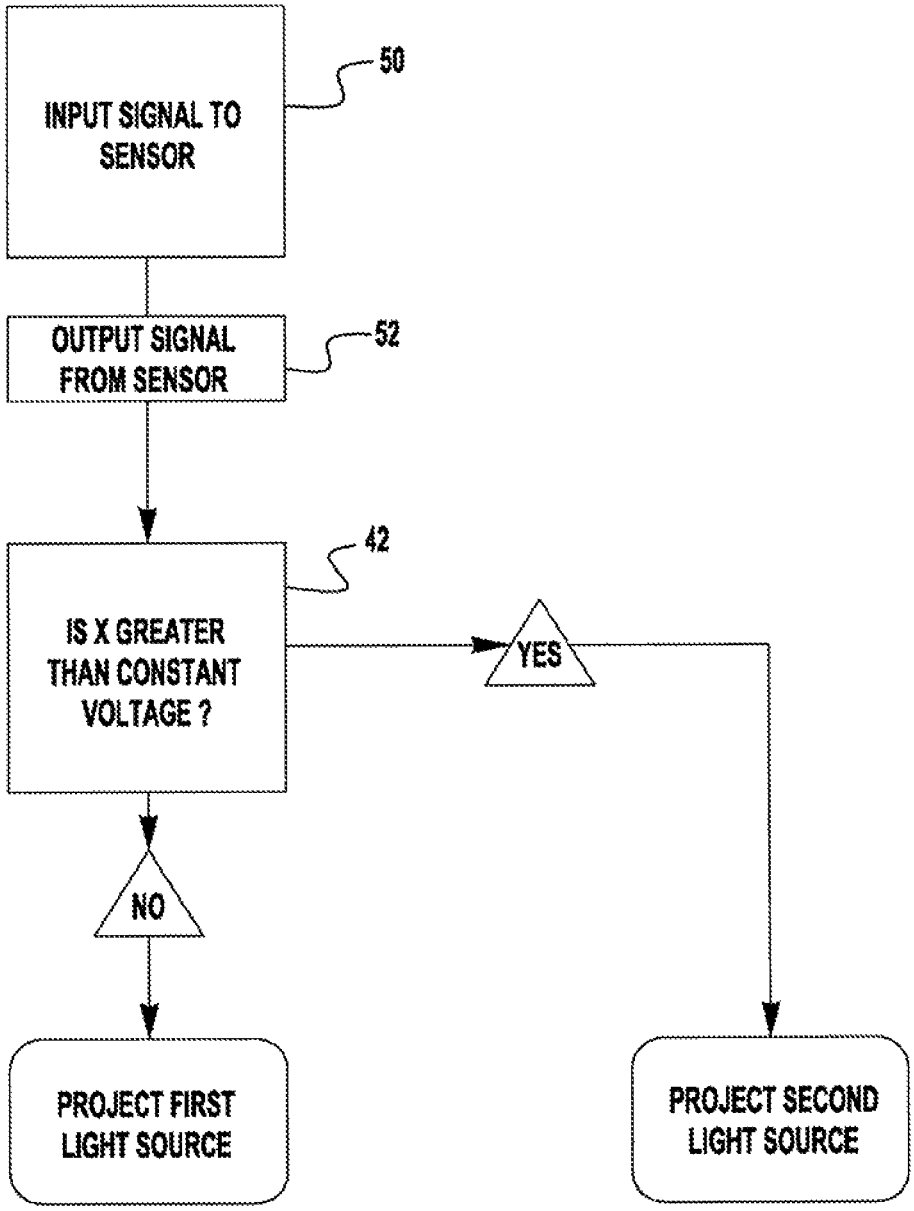
FIG. 7 is a decision tree used by the circuit of FIG. 6.

In various embodiments, referring to FIGS. 6 and 7, a saw can include at least one sensor configured to detect a saw condition, such as at least one of the above-described saw conditions, for example, and then transmit an output signal or pulse train to a comparator or a microprocessor, for example, wherein the signal can indicate the saw condition detected. In at least one embodiment, comparator 42, for example, can interpret the output signal, or pulse train, from sensor 40 and then output a signal to light emitter 32, for example. In at least one such embodiment, comparator 42 can interpret such a signal by comparing the voltage of the signal received from sensor 40 to a base value, such as the voltage which is indicative of a blade speed of zero, for example. In various embodiments, if the signal received by comparator 42 has a voltage which is equal, or at least substantially equal, to the base voltage, then comparator 42 can output a first signal to first light source 44 of the light emitter, for example, which indicates that the saw blade is stationary, or at least substantially stationary. If the signal received by comparator 42 has a voltage which is larger, or at least sufficiently larger, than the base voltage, then comparator 42 can output a second signal to second light source 46 of the light emitter, for example, which indicates that the blade is moving.

As outlined above, in various embodiments, sensor 40 can be configured to detect a first saw condition and/or a second saw condition of a saw. In various embodiments, sensor 40 can be placed in communication with a switch which is utilized to operate the saw. In at least one embodiment, when the switch has been manipulated into an engaged or 'on' position, for example, the switch can complete a signal circuit with motor 24, for example, wherein sensor 40 can be configured to detect the flow of current through the signal circuit. In addition to or in lieu of the above, in various embodiments, the sensor can include a zero-speed sensor, a tachometer, an optical sensor, a digital encoder, and/or any other suitable sensor configured to view or otherwise detect the movement, or the lack of movement, and/or speed of blade 12, arbor 20, and/or drive shaft 22.

In various embodiments, at least one of the blade, drive shaft, arbor, and/or other suitable drive component can include a magnet situated thereon which can be utilized to determine whether the blade is stationary and/or determine the speed of the blade. In at least one embodiment, the saw can further include a sensor which can detect the number of times that the magnet passes by the sensor over a predetermined time interval in order to determine the speed of the blade. In other various embodiments, a sensor can be configured to detect teeth located around the outer perimeter of the blade in order to determine whether the blade is moving based on whether intermittent light that may be visible (from the teeth being rotated past the sensor) during a predetermined time interval. Further to the above, in various embodiments, a tachometer can be operably engaged with blade 12, arbor 20, drive shaft 22, and/or motor 24, for example, which can be configured detect whether the blade is moving.

In various embodiments, a saw can include a vibration sensor configured to detect a vibration wave produced by the movement of the blade and/or motor of the saw, for example. In at least one embodiment, the vibration sensor can be configured to be mounted to one of motor 24, working surface 16, and/or any other suitable saw component such that it can, in effect, detect the movement and/or speed of blade 12. In various embodiments, the vibration sensor can be configured to detect a first condition, i.e., when no vibration wave is received by the sensor which exceeds a certain threshold level. In such circumstances, the vibration sensor can convey a signal to comparator 42 which can be interpreted such that a first signal is communicated to light emitter 32 to emit a first beam of light. When the sensor detects a vibration level which exceeds the threshold level, the sensor can convey a signal to comparator 42 which can be interpreted such that a second signal is communicated to light emitter 32 to emit a second of beam of light. In various embodiments, the intensity and/or frequency of the vibration wave, or waves, detected by the sensor can be utilized to determine the velocity of the saw blade.

Further to the above, a process for determining which light source of the light emitter should be powered, and thus visually presented to the operator, is illustrated in FIG. 7. In at least one embodiment, referring to FIGS. 6 and 7, sensor 40 can obtain or receive an input signal 50 by viewing or detecting at least one of the moving saw components. Thereafter, sensor 40 can then output signal 52 which can indicate the speed of the saw component to comparator 42. In various embodiments, for example, if signal 52 has a voltage (X) which is greater than a predetermined constant, or base, voltage for when the blade is in the stationary position, then the comparator 42 can instruct second light source 46 to emit a red light, for example, indicating that blade 12 may be moving. Similarly, if signal 52 has a voltage (X) which is equal, or at least substantially equal, to the base voltage, comparator 42 can instruct first light source 44 to emit a green light, for example, indicating that the blade may no longer be moving.

In various embodiments, any of the saw components outlined above, including but not limited to, the sensors, the comparator, the microprocessor, and/or the light emitter can be connected to each other through the use of at least one electrical conductor and/or wireless transmitter and receiver. In at least one embodiment, the components can be hard wired to each other through any suitable wiring technique such that a first end of a wire can be electrically connected to a first component and the other end of the wire can be electrically connected to a second component, for example. In various embodiments, at least one of the components can include a transmitter configured to wirelessly output a signal and, in addition, at least one of the components can include a receiver configured to receive the wireless signal. In still other embodiments, a combination of wires and wireless communication devices can be used to allow the saw components to communicate with each other. In various embodiments, at least some of the saw components, such as light emitter 32, sensor 40, and comparator 42, for example, can be placed in electrical communication with power supply 48, for example, such that power is supplied thereto. In at least one embodiment, power supply 48 can include a battery and/or other suitable power source. In various embodiments, the power supply can be integral to at least one of the saw components.

Figure 8:
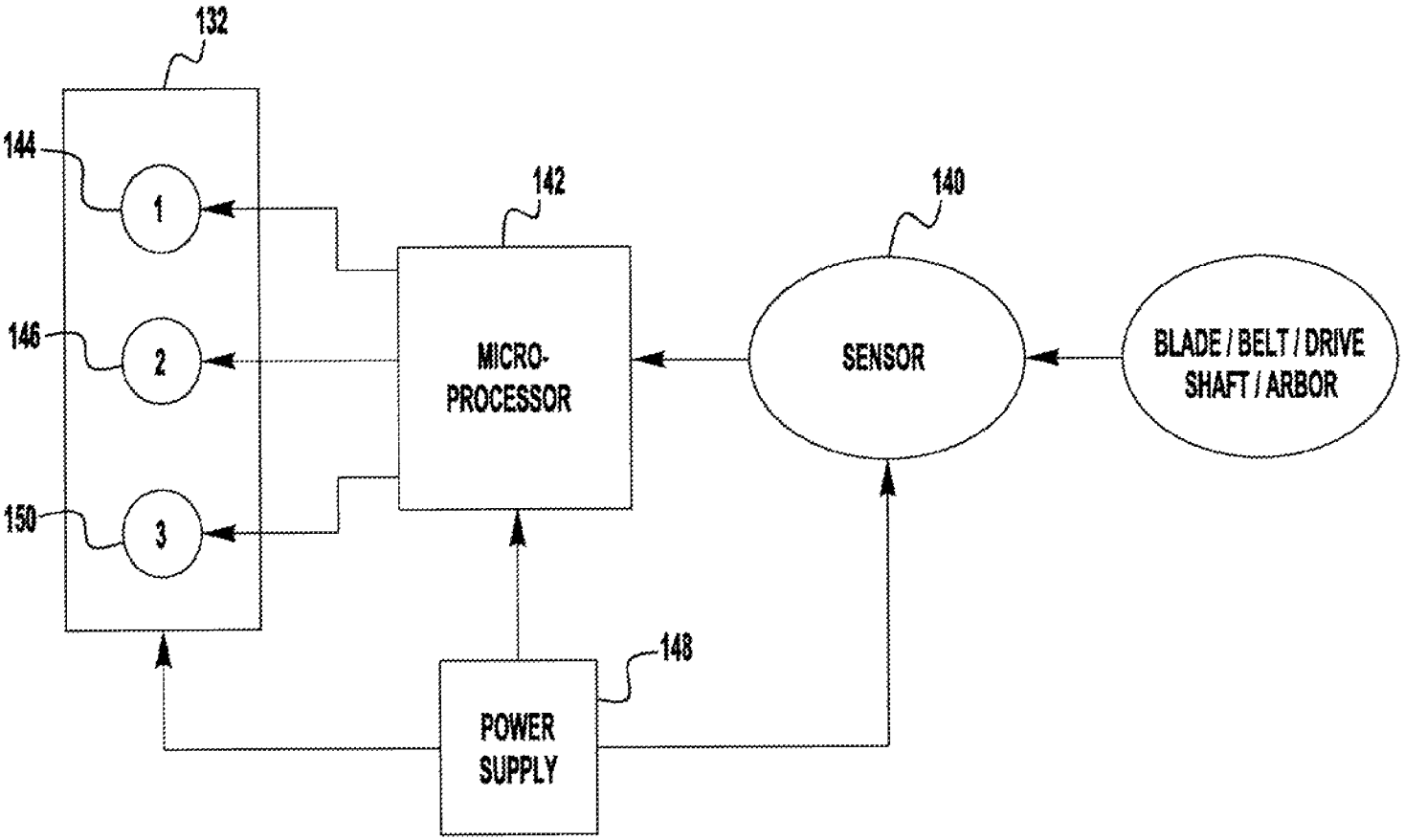
FIG. 8 is a diagram of a circuit used to selectively display first, second, and third lights in accordance with one non-limiting embodiment of the present invention.
Figure 9:
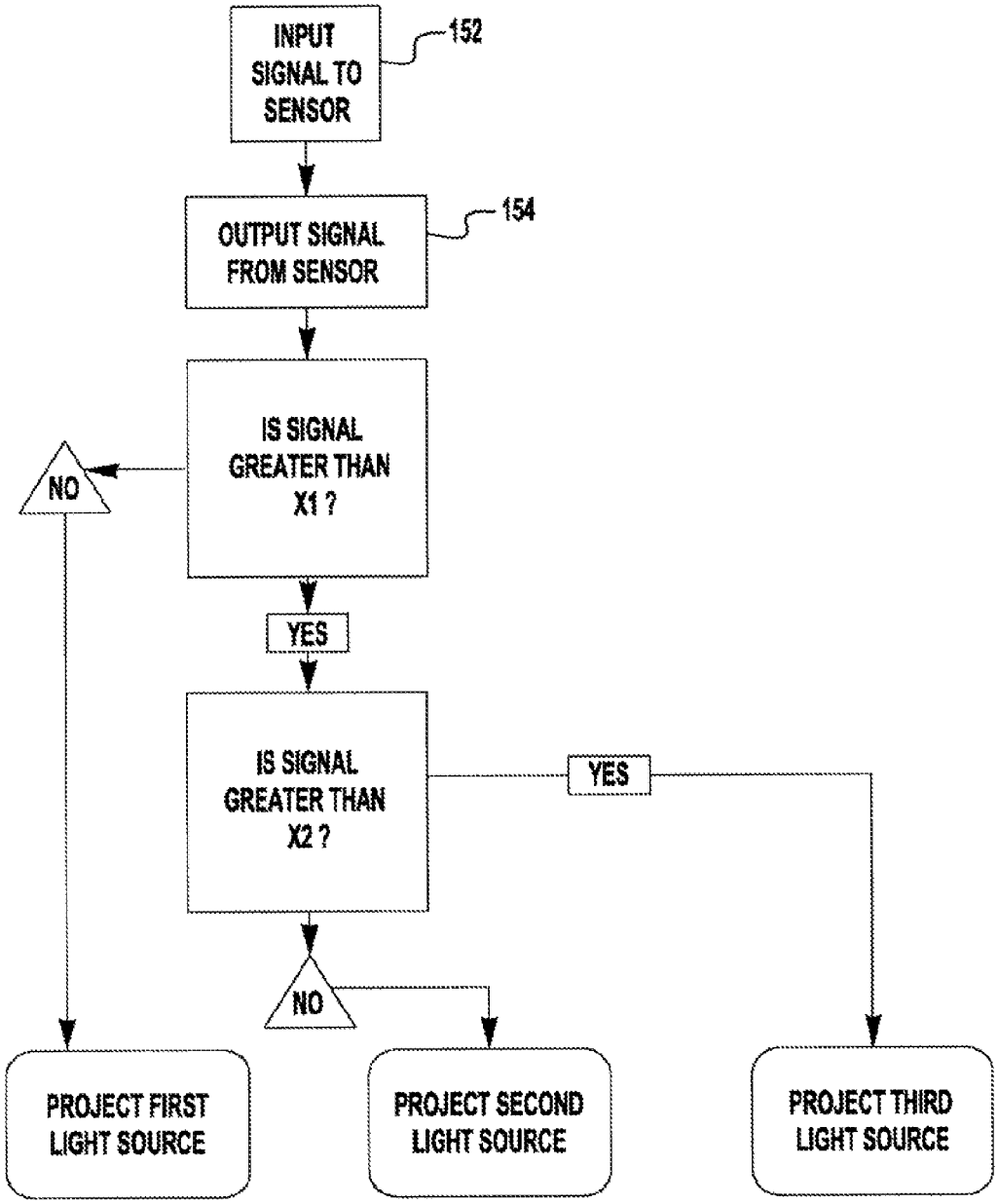
FIG. 9 is a decision tree used by the circuit of FIG. 8.

In various embodiments, referring to FIGS. 8 and 9, a saw can include at least one sensor 140 which can be in communication with microprocessor 142. In at least one embodiment, sensor 140 can be configured to detect whether the blade is stationary, moving at a first rate, or moving at a second rate. In various embodiments, sensor 140 can include a speed sensor, such as tachometer, for example, a digital encoder, and/or any other suitable speed sensing device which can receive or detect input signal 152. In various embodiments, the sensor can then output a pulse train or output signal 154 based on the movement of the saw component, or lack thereof.

Further to the above, in various embodiments, output signal 154 can then be communicated to microprocessor 142, for example, where signal 154 can be interpreted and/or converted into another output signal. In at least one embodiment, microprocessor 142 can have at least two voltage threshold levels, which can demarcate three voltage level ranges, for selectively directing the output signal from microprocessor 142 to one of light sources 144, 146, and 150, for example. In at least one embodiment, referring to FIG. 9, if signal 154 has a voltage which is less than voltage threshold level X1, microprocessor 142 can output a signal to first light source 144. Similarly, if signal 154 has a voltage less than voltage threshold level X2, but greater than voltage threshold level X1, microprocessor 142 can output a signal to second light source 146 and, correspondingly, if signal 154 has a voltage greater than X2, microprocessor 142 can output a signal to third light source 150.

In various embodiments, further to the above, light sources 144, 146, and 150 can each be configured to emit a light beam. In at least one embodiment, first light source 144 can be configured to emit a green light beam, second light source 146 can be configured to emit a yellow light beam, and third light source 150 can be configured to emit a red light beam, for example. In such instances, green can indicate that no power is available to motor 24, yellow can indicate that power is available to motor 24 but blade 12 is not rotating, and red can indicate that blade 12 is rotating, for example. In other various embodiments, any suitable light colors or patterns can be utilized to communicate information to the operator. In various embodiments, at least one of the light sources can be flashed intermittently to communicate a condition of the saw to the operator. In at least one such embodiment, a flashing light can indicate that a piece of debris is stuck between the saw blade and an adjacent portion of the saw, and/or whether a piece of scrap material or an unsuitable amount of saw dust has been left behind in area proximate to the saw blade. Such embodiments could be implemented through the use of a relay interrupting circuit, similar to the circuit used to operate the hazard lights on a car, for example.

Figure 10:
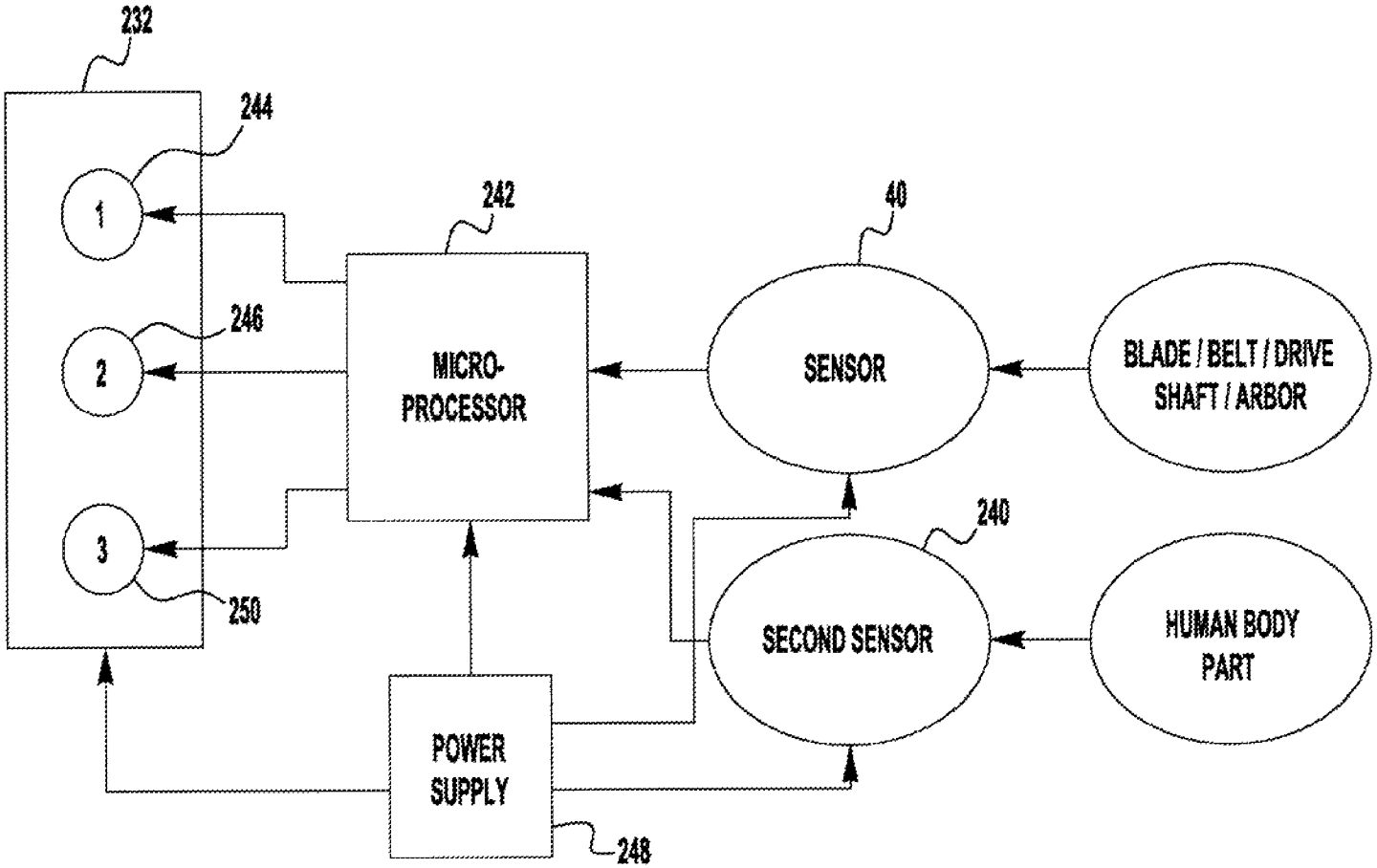
FIG. 10 is a diagram of a circuit having a microprocessor, two or more sensors, and a light emitter for selectively displaying first, second, and third lights in accordance with another non-limiting embodiment of the present invention.
Figure 11:
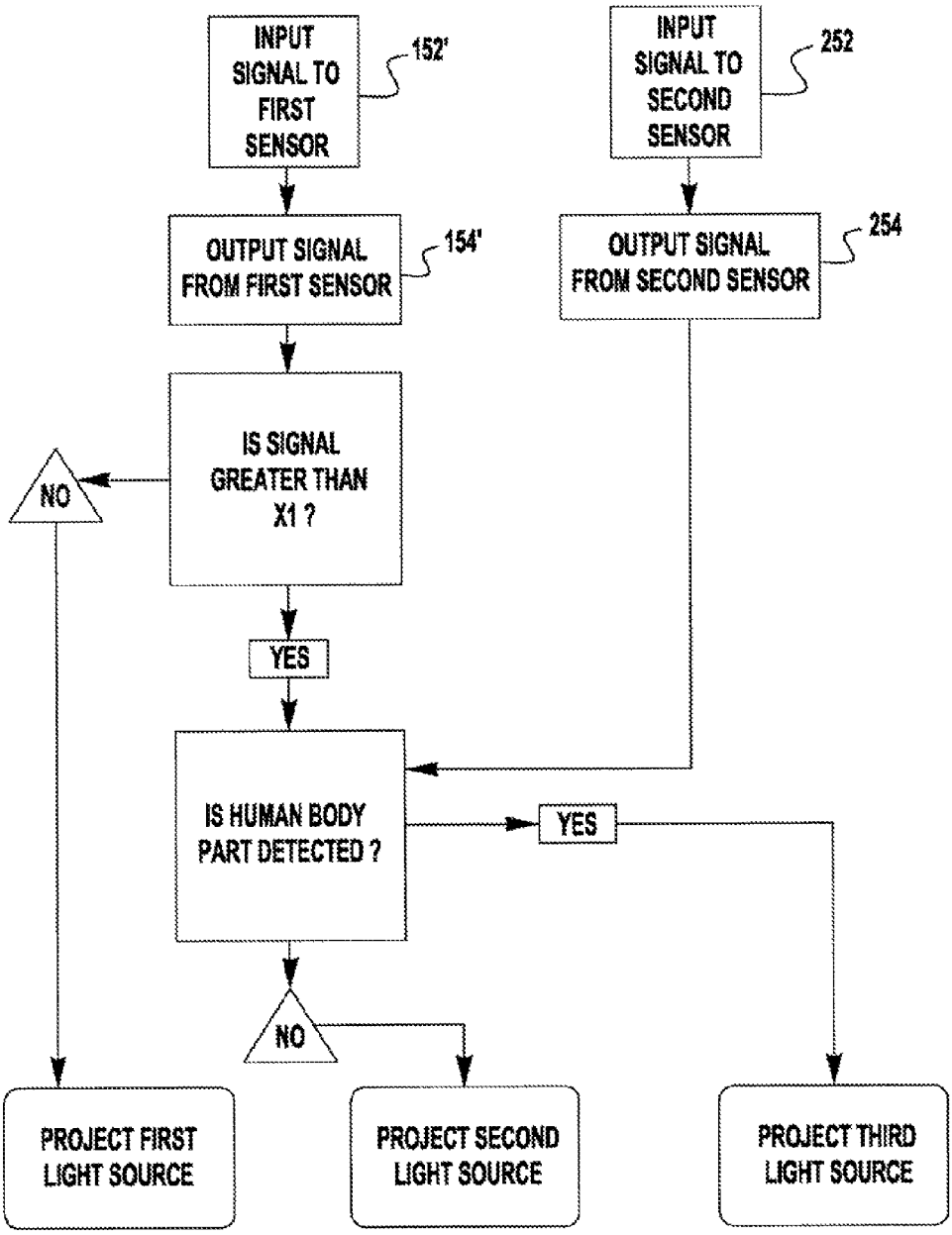
FIG. 11 is a decision tree used by the circuit of FIG. 10.

In various embodiments, the saw conditions indicated by the light emitter can occur when power is available to the saw, when the blade is rotating, as discussed above, and/or when a human body part is detected proximate to the rotating saw blade as discussed below. In at least one embodiment, referring to FIGS. 3, 10, and 11, second sensor 240 can be configured to detect human body part 36 and can work in conjunction with, or in lieu of, sensor 40 described above. In various embodiments, second sensor 240 can be positioned proximate to, or on, light emitter 232 and/or light emitter holder 234 and can be configured to view a portion of work surface 16 proximate to blade 12 such that sensor 240 can obtain input signal 252 wherein input signal 252 can be indicative of whether human body part 36 is proximate to the blade. In other various embodiments, sensor 240 can be positioned at any other suitable location on the saw. In various embodiments, if human body part 36 is detected between sensor 240 and work surface 16 and/or in an area proximate to blade 12, second sensor 240 can transmit a pulse train or an output signal 254 to microprocessor 242. In at least one embodiment, microprocessor 242 can receive and interpret the pulse train or output signal 254 and then output a signal to light emitter 232 to activate third light source 250 and emit a third light beam, including a third color, onto work surface 16 and/or workpiece 18. In at least such an embodiment, the third light beam can indicate to the operator that a portion of their body is within a zone of danger surrounding blade 12. In various embodiments, the zone of danger can be defined within or near the perimeter of light beam 11 (FIG. 3), for example. When human body part 36 is detected within the zone of danger, in at least one embodiment, an audible alarm can also be provided which can alert the operator of their hand's proximity to blade 12. In various embodiments, similar to the above, microprocessor (or comparator) 242 can illuminate the first and second light sources 244 and 246 in a similar fashion as light sources 44 and 46 outlined above. In at least one embodiment, power supply 248 can supply power to microprocessor 242, light emitter 232, sensor 240 and/or any other suitable saw components. Further, in various embodiments, microprocessor 242, light emitter 232, and sensor 240 can be electrically connected to each other in any suitable manner including those described above.

In various embodiments, second sensor 240 can be, for example, a diffuse reflectance near-infrared sensor utilized in conjunction with a near-infrared source and configured to detect the presence of molecular structures associated with human tissues and/or human body parts. In at least one embodiment, the sensor may be configured as a probe included on an optical fiber which may be positioned such that the sensor is configured to detect the presence of the human body part proximate to the blade. In various embodiments, a reflectance infrared sensor may be utilized with an infrared source, for example. In at least one embodiment, the sensor may be remotely positioned from a corresponding light source to allow for increased signal return for the system, to account for a desired angle of return, and to minimize dust interference. In various embodiments, any suitable electro-optical sensors, which utilize various spectroscopic techniques, may be implemented based on cost effectiveness, site conditions, durability, ease of use, reliability, susceptibility to dust interference, and/or for any other suitable reason. In at least one embodiment, an Indium-Gallium-Arsenic type sensor may be utilized to detect molecular structures associated with human tissue associated in wavelengths in the near-infrared region of the light spectrum. In various embodiments, the foregoing system may implement reflectance or diffuse reflectance detection, or in other various embodiments, a particular wavelength, or narrow range of wavelengths, may be selected as representative of the human body part. Additionally, in various embodiments, the sensor may be configured to allow for detection materials commonly used in gloves which may be worn by the operator. In at least one embodiment, a range of wavelengths may be selected such that if the operator wears leather gloves, or the like, the sensor may determine if the operator's hand is within a beam of light, for example. In other various embodiments, mirrors may be utilized to focus the returned energy signal (such as from human tissue and/or the workpiece).

In various embodiments, suitable sensors 240 can include reflectance based techniques such as reflectance or diffuse reflectance (e.g., far-infrared, near-infrared, infrared, or a combination thereof) or the like where reflected energy is detected. In other various embodiments, the sensor may include analyzer hardware and/or software for conducting analysis of the return signal. In at least one embodiment, an optical proximity device can include a sensor configured to analyze a range of wavelengths to determine the presence of the human body part in the projected light beam. In various embodiments, a separate analyzer may be included to evaluate the return signal. In at least one embodiment, the sensor can scan a range of wavelengths or merely detect in a predetermined wavelength or narrow band of wavelengths. In at least such an embodiment, if a specific wavelength is selected, the source may be simplified or configured to project additional energy at a corresponding energy range.

In various embodiments, if sensor 240 detects the presence of the human body part in the light beam, sensor 240 can communicate with microprocessor 242 which can then signal light emitter 232 to cause third light source 250 to emit a third light beam, including a third color, onto work surface 16 and/or workpiece 18 to indicate to the operator that their hand is proximate to the blade. In other various embodiments, sensor 240 may, in addition to projecting the third light source, initiate a passive stopping technique such as by turning off the actuator driving the blade for passively preventing the operator from contacting the moving saw blade. In at least one embodiment, countermeasure device 300 (FIG. 4) can be configured for conducting an active stopping technique. In various embodiments, examples of suitable countermeasure devices can include mechanical brakes, electric actuator brakes (preferably in conjunction with turning-off the actuator), sacrificial brakes (e.g., a brake which stops the saw blade by damaging the blade or drive shaft) (for example an aluminum block contacts the blade's teeth), a device which blocks operator contact with the blade, or any other suitable device for actively stopping the blade. In various embodiments, sensor 240 may be communicatively coupled to actuator 24 in order to prevent the actuator, or motor, from driving blade 12. In at least one embodiment, a solenoid can be activated to drive opposing brake arms to engage the saw blade. In other various embodiments, an optical detector may be configured to initiate a passive stopping technique at a remote position (relative to the saw) and an active technique at a proximal position closer to the blade than the remote position. Alternatively, in still other various embodiments, a biasing device which can be arrested by an extended solenoid may be included. In various embodiments, a brake pad with a sufficiently high coefficient of friction may be utilized to stop the blade without causing damage thereto. In other various embodiments, a pyrotechnic operated mechanical or a sacrificial brake may be utilized. In at least one embodiment, an arbor assembly, including the arbor, can be constructed such that a solenoid or a pyrotechnic charge may drive the arbor assembly away from the operator (remove the blade from the operator) such as below the work surface. While a passive or non-destructive countermeasure device is disclosed, a sacrificial braking system may also be employed. Those of skill in the art will appreciate that other various devices may be implemented to stop the blade without departing from the scope and spirit of the present disclosure. Further details regarding the human body part detection systems and the various blade stopping techniques described herein can be found in U.S. patent application Ser. No. 10/797,486, which was filed on Mar. 10, 2004 and is entitled OPTICAL PROXIMITY DEVICES FOR POWER TOOLS, the disclosure of which is hereby incorporated by reference herein.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A safety device configured to be used with a saw, wherein the saw includes a blade at least partially extending through a work surface adjacent the blade, the safety device comprising:

a light emitter, wherein said light emitter is configured to direct a first light beam and a second light beam onto a work surface surrounding the blade;

a sensor, wherein said sensor is configured to detect a first saw condition and a second saw condition, wherein said light emitter is configured to be in communication with said sensor, wherein said light emitter is configured to direct the first light beam when said sensor detects the first saw condition, and wherein said light emitter is configured to direct the second light beam when said sensor detects the second saw condition; and a switch configured to disrupt power to the saw blade when said sensor detects the second saw condition.

2. The safety device of claim 1, further comprising a brake configured to stop the saw blade when said sensor detects the second saw condition.

3. The safety device of claim 2, wherein the brake comprises a mechanical brake.

4. The safety device of claim 2, wherein the brake comprises an electric actuator brake.

5. The safety device of claim 2, wherein the brake comprises a sacrificial brake.

6. The safety device of claim 1, wherein the sensor is further configured to detect a third saw condition, and further comprising a brake configured to stop the saw blade when said sensor detects the third saw condition.

7. The safety device of claim 6, wherein the brake comprises a mechanical brake.

8. The safety device of claim 6, wherein the brake comprises an electric actuator brake.

9. The safety device of claim 6, wherein the brake comprises a sacrificial brake.

10. A saw configured to motivate a blade and cut a workpiece, the saw comprising:

a work surface, wherein the blade is configured to at least partially extend above said work surface;

a light emitter, wherein said light emitter is configured to direct a first light beam and a second light beam onto a work surface surrounding the blade;

a sensor, wherein said sensor is configured to detect a first saw condition and a second saw condition, wherein said light emitter is configured to be in communication with said sensor, wherein said light emitter is configured to direct the first light beam when said sensor detects the first saw condition, and wherein said light emitter is configured to direct the second light beam when said sensor detects said second saw condition; and a switch configured to disrupt power to the saw blade when said sensor detects the second saw condition.

11. The safety device of claim 10, further comprising a brake configured to stop the saw blade when said sensor detects the second saw condition.

12. The safety device of claim 11, wherein the brake comprises a mechanical brake.

13. The safety device of claim 11, wherein the brake comprises an electric actuator brake.

14. The safety device of claim 11, wherein the brake comprises a sacrificial brake.

15. The safety device of claim 10, wherein the sensor is further configured to detect a third saw condition, and further comprising a brake configured to stop the saw blade when said sensor detects the third saw condition.

16. The safety device of claim 15, wherein the brake comprises a mechanical brake.

17. The safety device of claim 15, wherein the brake comprises an electric actuator brake.

18. The safety device of claim 15, wherein the brake comprises a sacrificial brake.

19. A safety device configured to be used with a saw, wherein the saw includes a blade at least partially extending through a work surface adjacent the blade, the safety device comprising:

emitting means for directing a first light beam and a second light beam onto a work surface surrounding the blade; and detecting means for detecting a first saw condition and a second saw condition, wherein the emitting means emits the first light beam when the first saw condition is detected, and wherein the emitting means emits the second light beam when the second saw condition is detected.

20. A safety system for use with a saw configured to motivate a blade and cut a workpiece, the saw comprising a work surface, wherein the blade is configured to at least partially extend above said work surface, said safety system comprising:

a light emitter, wherein the light emitter is configured to aim a first light beam and a second light beam onto the work surface surrounding the blade; and a sensor, wherein said sensor is configured to detect a first saw condition and a second saw condition, wherein said light emitter is in communication with said sensor, wherein said light emitter is configured to aim the first light beam onto one of the work surface surrounding the blade and the workpiece when said sensor detects the first saw condition, and wherein said light emitter is configured to aim the second light beam onto one of the work surface surrounding the blade and the workpiece when said sensor detects the second saw condition.

* * * * *